US006196538B1

(12) United States Patent
Stauber et al.

(10) Patent No.: US 6,196,538 B1
(45) Date of Patent: Mar. 6, 2001

(54) APPARATUS FOR PROCESSING FLEXIBLE, SHEET-LIKE PRODUCTS

(75) Inventors: Hans-Ulrich Stauber, Grüt; Alex Keller, Eschenbach, both of (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/332,814

(22) Filed: Jun. 14, 1999

(30) Foreign Application Priority Data

Jun. 15, 1998 (CH) ..... 1283/98

(51) Int. Cl.[7] ..... B65H 29/68

(52) U.S. Cl. ..... 271/69; 271/81; 271/184; 271/314; 271/272; 198/470.1; 198/803.3

(58) Field of Search ..... 271/184, 185, 271/314, 81, 82, 83, 204, 66, 69, 70, 272; 198/470.1, 803.3, 803.9

(56) References Cited

U.S. PATENT DOCUMENTS

| | | | | |
|---|---|---|---|---|
| 4,813,662 | * | 3/1989 | Merwarth et al. | 271/82 |
| 4,895,360 | | 1/1990 | Reist . | |
| 4,896,874 | | 1/1990 | Muller . | |
| 5,031,893 | * | 7/1991 | Yoneda et al. | 271/184 |
| 5,395,151 | | 3/1995 | Eberle . | |
| 5,452,886 | | 9/1995 | Cote et al. . | |
| 5,556,086 | | 9/1996 | Munneke et al. . | |
| 5,794,929 | * | 8/1998 | Curley et al. | 271/82 |
| 5,857,829 | | 1/1999 | Achelpohl . | |

FOREIGN PATENT DOCUMENTS

| | | |
|---|---|---|
| 0 332 828 B1 | 2/1989 | (EP) . |
| 0 332 828 B1 | 9/1989 | (EP) . |
| 0 499 691 A1 | 8/1992 | (EP) . |
| 2555938 | 6/1985 | (FR) . |

OTHER PUBLICATIONS

Swiss International Search Report.

* cited by examiner

*Primary Examiner*—H. Grant Skaggs
(74) *Attorney, Agent, or Firm*—Brink Hofer Gilson & Lione

(57) ABSTRACT

The apparatus has an intermediate conveyor (18) with conveying elements (26) distributed in the circumferential direction on bearing plates (36). Each conveying element (26) has a roller segment (54), which is driven counter to the direction of circulation (U), and a belt conveyor (56) which is assigned to said roller segment. A control device (48) keeps the conveying elements (26) in a mutually parallel position during circulation in the direction of circulation (U). During movement past the receiving location (16), a rear section (82) of the roller segment (54) and the belt conveyor (56) form an introduction gap (24) for a product (14) fed by a feed conveyor (12) in each case. During further rotation, said product (14) is moved through the conveying element (26), in the conveying gap (90) now formed by the roller segment (54) and belt conveyor (56), and is deflected by means of the guide element (92). At the transfer location (50), the product (14) is thus introduced into a gripper (96) of a removal conveyor (52), whereupon the conveying gap (90) is eliminated. The apparatus, while maintaining the sequence of the products (14), changes the position of the latter such that the sides (20, 20') of the products (14), said sides facing one another in the fed imbricated stream (S), are changed round.

14 Claims, 4 Drawing Sheets

APPARATUS FOR PROCESSING FLEXIBLE, SHEET-LIKE PRODUCTS

BACKGROUND OF THE INVENTION

The present invention relates to an apparatus for processing flexible, sheet-like products having a feed conveyor for delivering the products to a receiving region of an intermediate conveyor which has a number of conveying elements arranged, one behind the other. The conveying elements moved in the direction of circulation along a circulatory path running through the receiving region and through a transfer region. This conveying process changes the position of the products fed to successive conveying elements in the receiving region such that the sequence of the products remains the same however, the mutually facing sides of the products are changed.

An apparatus of this type is disclosed in the earlier Switzerland Patent Application No. 1998 0476/98. By means of the conveying elements, which are designed as grippers, the products retained by the latter are drawn round the respectively following gripper from one side of said gripper to the other, which, in the case of a high processing capacity, requires high gripper retaining forces and subjects the products to considerable stressing.

Furthermore, EP-A-0 332 828 discloses an apparatus for separating stacked paper sheets. The separating apparatus has a rotary feeder which is assigned a stationary feeder magazine for receiving a stack of the paper sheets that are to be separated. The rotary feeder has hollow shafts which are arranged in a cage-like manner on equiaxially mounted disc plates and are driven counter to the direction of rotation of the disc plates. Three drum disc plates with a segment-like recess are positioned in a rotationally fixed manner on each hollow shaft. Provided on both sides of the drum disc plates are suction members which project radially away from the hollow shaft and of which the suction heads are aligned with the recesses of the drum disc plates. In the case of each hollow shaft, an endless guide belt wraps around the central drum disc plate over approximately half a circumference and, between the respectively adjacent hollow shafts, is guided around a deflecting roller mounted on the disc plates. The drum disc plates and guide rollers arranged between the latter in the circumferential direction of the rotary feeder serve as a rest for the stack arranged in the magazine. When the rotary feeder rotates, the suction members running in beneath the stack are subjected to a vacuum, with the result that they grip the lowermost printed sheet at the fold. During further rotary movement, the drum disc plates roll on the gripped printed sheet and the suction members retain the fold until the latter has been clamped in between the central drum disc plate and the guide belt. The sheet is then retained by the guide belt in abutment with the drum disc plates, carried away from the stack by a stripping-off action and then, at a transfer location, along with the action of the deflecting rollers, beyond the circumferential circle of the rotary feeder, introduced into a gripper of a removal conveyor with the fold in front.

BRIEF SUMMARY OF THE INVENTION

It is an object of the present invention to provide an apparatus of the type mentioned in the background which, when used in a high processing capacity, ensures careful handling of the products and avoids damage to the products. It should be appreciated that a damaged product could cause the apparatus to jam and require it to be shut down for servicing.

This object is achieved by an apparatus for processing flexible, sheet-like products, having a feed conveyor for delivering the products to a receiving region of an intermediate conveyor. The intermediate conveyor has a number of conveying elements that are arranged one behind the other. The conveying elements move along a circulatory path that passes through the receiving region and then through a transfer region. This conveying process changes the position of the products relative to each other. The mutually facing sides of products that in the receiving region are no longer mutually facing when they arrive at the transfer region. However, during the conveying process the sequence of the products remains the same. The conveying elements including roller segment that rotate about their axis which extends at right angles to the circulatory path of the conveying elements. The conveying elements interacts with a mating element during movement through the receiving region. A rear section of the roller segment and the mating element form an introduction gap for the fed product. In a section of the circulatory path, following the receiving region, a circumferentially running lateral-surface section of the roller segment, that follows the rear section, and the mating element form a conveying gap for said product.

The intermediate coonveyor includes a control device that functions to keep the conveying elements in substantial mutual parallel position to one another. A removal conveyor blends with the intermediate conveyor in the discharge region and receives the products from the conveying elements.

BRIEF DESCRIPTION OF SEVERAL VIEWS OF THE DRAWINGS

The invention is described in more detail hereinbelow with reference to exemplary embodiments illustrated in the drawings, in which.

DETAILED DESCRIPTION OF THE INVENTION

Figure 1:
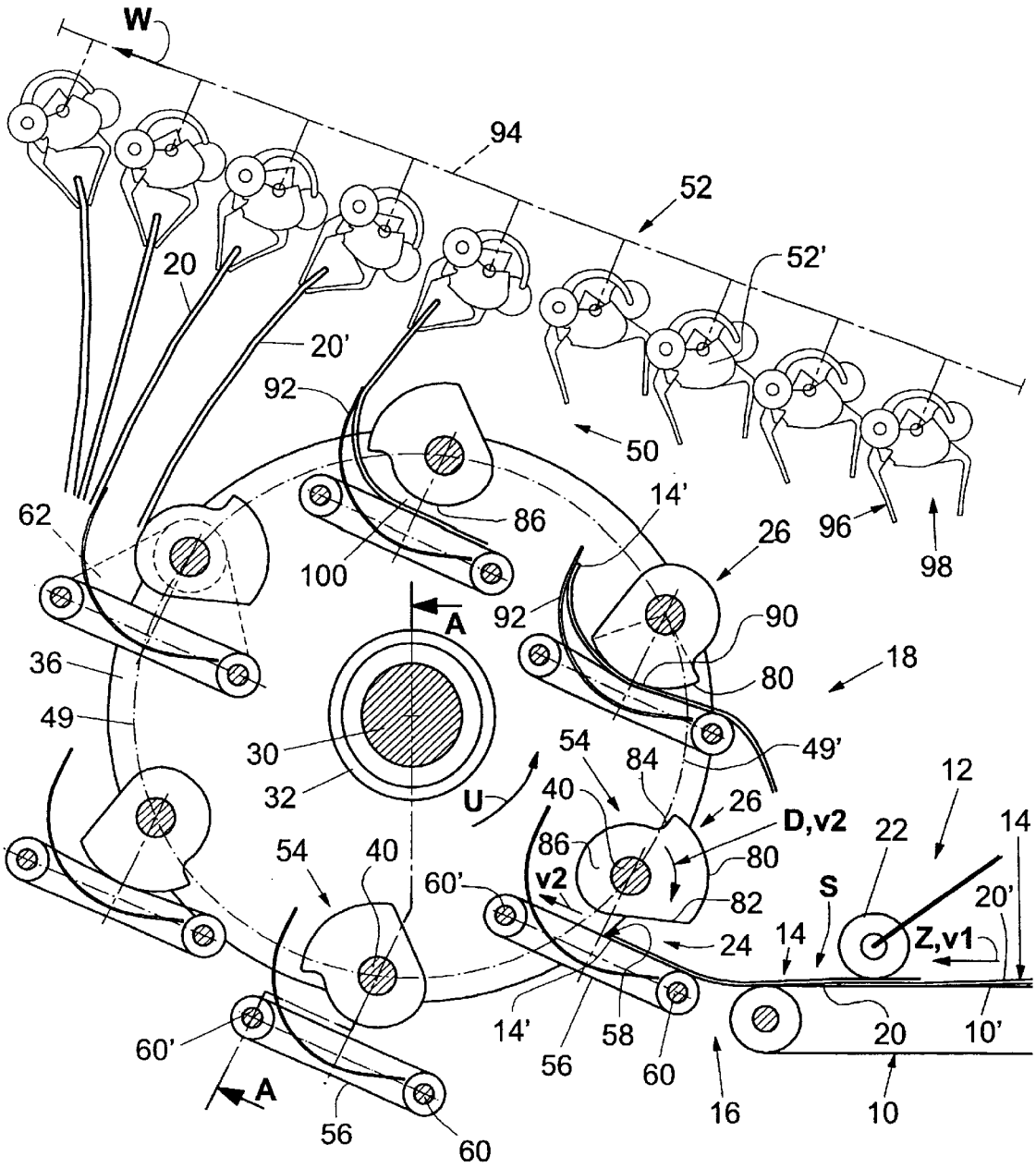
FIG. 1 shows, in a longitudinal section, an apparatus according to the invention.
Figure 2:
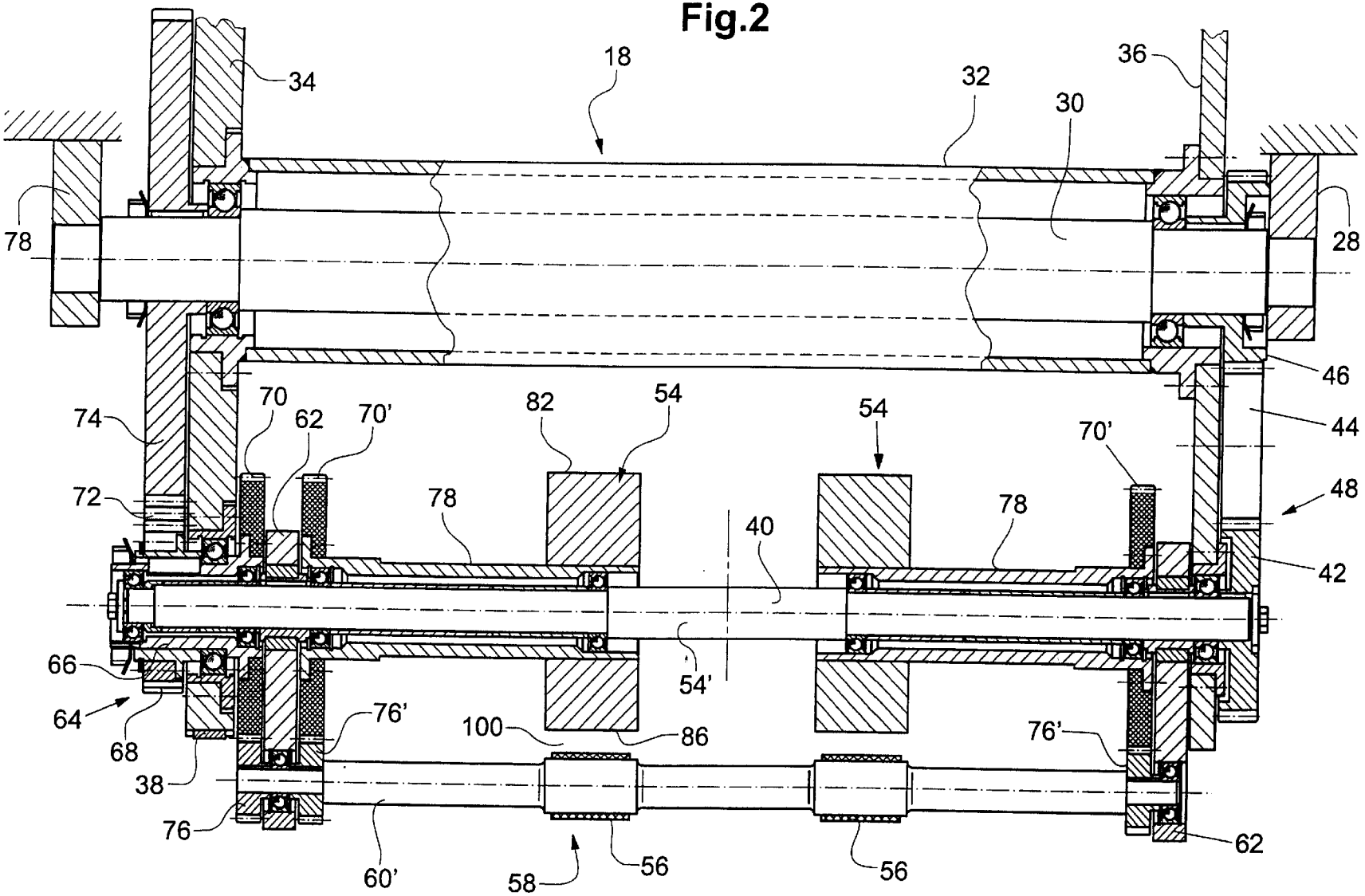
FIG. 2 shows, in a section along line A—A of FIG. 1, part of the apparatus shown in FIG. 1.

The apparatus which is shown in FIGS. 1 and 2 has a feed conveyor 12 which is designed as a belt conveyor 10 and is driven in the feed direction Z. It is intended for feeding flexible, sheet-like products 14 arriving in an imbricated stream S, in the present case printed products such as newspapers, periodicals or the like, to a receiving region 16 of an intermediate conveyor 18. The receiving region 16 being arranged at the downstream end of the belt conveyor 10. In the imbricated stream S, each product 14 rests with the leading edge 14'—in the present case the fold—on the following product 14. The mutually facing sides of the overlapping products 14 are designated by 20 and 20'.

Interacting with the active strand 10' of the belt conveyor 10 is a weight roller 22; that is intended for introducing into an introduction gap 24 of a conveying element 26 of the intermediate conveyor 18 the foremost product 14 of the imbricated stream S, as seen in the feed direction Z in each case.

The intermediate conveyor 18 has a spindle 30 which is arranged in a rotationally fixed and stationary manner on a machine framework 28 and on which a hollow shaft 32 is mounted in a freely rotatable manner. Fastened on the two end sides of said hollow shaft is, in each case, one disc-like bearing plate 34, 36, it being the case that the bearing plate 34, which is shown on the left-hand side in FIG. 2, has a toothed belt 38 which is connected to a drive motor and is intended for driving the intermediate conveyor 18 gripping round it.

Mounted in a freely rotatable manner on the bearing plates 34, 36, and distributed in a uniform manner in the circumferential direction along a circle that is coaxial with the spindle 30, are six shafts 40 which run parallel to the spindle 30 and, at both ends, project outward beyond the bearing plates 34, 36. Wedged onto that end region of each shaft 40 which projects beyond the bearing plate 36, which is shown on the right-hand side in FIG. 2, is a gear wheel 42 which meshes with an intermediate wheel 44 which is mounted in a freely rotatable manner on the bearing plate 36. Wheel 44 meshes with a center wheel 46 which is fastened on the fixed spindle 30 and is the same size as the gear wheel 42. These gear wheels 42, 44, 46 form a planet-gear-mechanism-like control device 48. During rotation of the bearing plates 34, 36 in the direction of rotation U about the spindle 30, the planet-gear mechanism 48 functions to retain the shafts 40 in a rotationally fixed manner in relation to the machine framework 28. Arranged on each of these shafts 40 is a conveying element 26 which is intended for receiving a fed product 14 in the receiving region 16, for transporting said product in the direction of circulation U along a circulatory path 49. The product 14 is then transferred, in a transfer region 50, to a removal conveyor 52 designed as a gripper conveyor 52'.

Each conveying element 26 has two roller segments 54 which are mounted in a freely rotatable manner on the relevant shaft 40 and of which the roller-segment axes 54' coincide with the longitudinal axis of the shaft 40. Each roller segment 54 is assigned a mating element 58 designed as a belt conveyor 56. The two belt conveyors 56 of a conveying element 26 are guided at both ends in each case about deflecting shafts 60, 60' which, for their part, are mounted in a freely rotatable manner on approximately triangular carrier plates 62 which are wedged onto the shaft 40. During rotation of the bearing plates 34, 36, said carrier plates, and thus the conveying elements 26, maintain a mutually parallel position.

A drive arrangement 64 drives the roller segments 54 in the direction of rotation D, counter to the direction of circulation U of the bearing plates 34, 36. At the same time, the drive arrangement 64 drives the belt conveyors 56, in the opposite direction of rotation, at the same circumferential speed $v_2$ as the roller segments 54. This speed $v_2$ is coordinated in relation to the conveying speed $v_1$ of the feed conveyor 12.

The drive arrangement 64 has a hollow stub-shaft 66 which is mounted in a freely rotatable manner on the bearing plate 34. Hollow stub-shaft 66 penetrates bearing plate 343. A drive wheel 68 is positioned on hollow stub-shaft 66 in a rotationally fixed manner on the outer side of bearing plate 34 and a gear wheel 70 is positioned on hollow stub-shaft in a rotationally fixed manner on the inner side of bearing plate 34. The drive wheel 68 meshes with a further intermediate wheel 72, which is mounted in a freely rotatable manner on the bearing plate 34 and, for its part, meshes with a further center wheel 74, which is fastened on the spindle 30. In terms of diameter, said center wheel 74 is considerably larger than the drive wheel 68, as a result of which the hollow stubshaft 66 is driven counter to the direction of circulation U at a rotational speed which is higher than the rotational speed of the bearing plates 34, 36. The gear wheel 70 meshes with a pinion 76 wedged onto the deflecting shaft 60'. As seen in the direction of the shaft 40, one carrier plate 62 is arranged adjacent to the gear wheel 70, on the side of the latter which is directed away from the bearing plate 34, whereas the other carrier plate is positioned on the shaft 40 adjacent to the bearing plate 36. Between the two carrier plates 62, two further hollow shafts 78, which are of the same design and are arranged opposite one another, are mounted in a freely rotatable manner on the shaft 40. On each of these further hollow shafts 78, in each case one of the roller segments 54 is positioned at the mutually facing end regions and in each case one further gear wheel 70' is positioned at the end regions which are directed away from one another and are directed toward the carrier plates 26; these gear wheels 70' are of the same design as the gear wheel 70. Meshing with said further gear wheels 70' are further pinions 76', which are likewise wedged onto the deflecting shaft 60' and are of the same design as the pinion 76. The drive arrangement 64 thus also acts in the manner of a planet gear mechanism. In the example shown, the ratio of the rotational speed of the roller segments 54 to that of the bearing plates 34, 36 is 3:1.

For the sake of completeness, it should be mentioned that in the case of the bearing plate 34, which is shown on the left-hand side in FIG. 2, the shaft 40 in the interior of the hollow stub-shaft 66 is mounted in a freely rotatable manner on the latter.

Each roller segment 54 has a lateral-surface section 80 which runs coaxially with the associated shaft 40 over a certain angle region of, for example, approximately 90°. The leading end of the lateral-surface section 80, as seen in the direction of rotation D, is joined by a rear section 82 which runs in the manner of a chord in relation to an imaginary full cylinder. The trailing end of the lateral-surface section 80 is adjoined by a radially inwardly running section 84 which—apart from transition curves—is connected to the rear section 82 via a further section 86, which is coaxial with the shaft 40. The distance between the axis of the shaft 40 and said further section 86 is smaller than the relevant distance to the lateral-surface section 80 and also smaller than the distance between the axis and the belt conveyor 56.

The rotation of the roller segments 54 and the rotation of the bearing plates 34, 36 are synchronized such that, during movement through the receiving region 16, from bottom to top of a conveying element 26, the relevant belt conveyors 56 and the roller segments 54, with their rear section 82, form a tapering introduction gap 24, as seen in the feed direction Z, which is temporarily aligned with the belt conveyor 10. This makes it possible for the relevant product 14 to be introduced without obstruction into the conveying element 26, by means of the feed conveyor 12, with its edge 14' in front. Since, in the receiving region 16, the deflecting shaft 60 of the belt conveyors 56, which are arranged beneath the roller segments 54, is arranged outside the roller segment 54, as seen in the radial direction, the belt conveyors 56 grip beneath the corresponding product 14, which projects beyond the belt conveyor 10 in each case, and raise the same in the direction of circulation U. Shortly before the relevant product 14 is released by the weight roller 22, the roller segment 54 has been rotated further counter to the direction of circulation U to the extent where the lateral-surface section 80 comes into abutment against the product 14. The belt conveyors 56 and the roller segments 54 then form a conveying gap 90, through which the products 14 are then conveyed during further rotation of the bearing plates 34, 36. The endless belts of the belt conveyors 56 are of elastic design in order to ensure that the products 14 are reliably transported through the conveying elements 26 irrespective of the thickness of the products 14.

Furthermore, each conveying element 26 has guide elements 92 which are fastened on the relevant carrier plates 62 and, downstream of the conveying gap 90, deflect the products 14 around the roller segments 54 in the upward direction, away from the belt conveyors 56.

The removal conveyor 52 runs beyond the intermediate conveyor 18 and has grippers 96 arranged at intervals one behind the other on its endless drawing member 94, which is driven in circulation in the removal-conveying direction W, said grippers being known, for example, from EP-A-O 600 183 and the corresponding U.S. Pat. No. 5,395,151. The removal conveyor 52 and the intermediate conveyor 18 are synchronized such that in the transfer region 50, which is arranged above the spindle 30, a gripper 96 with gripper mouth 98 open in the downward direction interacts with each conveying element 26. The two roller segments 54 of the conveying elements 26 are spaced apart from one another to the extent where the gripper tongues, which form the gripper mouth 98, can be moved through therebetween. In each case one conveying element 26 and one gripper 96 run in the transfer region 50 together, it being the case that the upwardly deflected product 14 passes into meshing engagement with the gripper mouth 98. Upon leaving the transfer region 50, the relevant gripper 96 is closed in a known manner and the conveying gap 90 is eliminated at least more or less at the same time by virtue of the rear end of the lateral-surface section 80 running off from the belt conveyor 56 and releasing the product 14. As a result of the radially running section 84, this release takes place in a very short period of time. The further section 86 and the belt conveyors 56 then form a guidance gap 100 for the product 14, which is gripped and retained by a gripper 96 and can be drawn out of the guidance gap 100 without resistance. The conveying gap 90 is thus present in a section of the circulatory path 49, said section extending into the transfer region 50 from the receiving region 16.

Between the receiving region 16 and the transfer region 50, the products 14, which are fed with mutual overlapping, are thus changed in position, by virtue of being deflected around the roller segments 54, such that, with the sequence remaining the same, the previously facing sides 20 and 20' are directed away from one another.

The belt conveyor 10 preferably runs at least more or less in the horizontal direction and, as seen in the vertical direction, between the spindle 30 and the lowermost section of the circulatory path 49, whereas, during movement through the receiving region 16, the belt conveyors 56 run obliquely upward, as seen in the feed direction Z.

The length of the lateral-surface section 80 and the distance of the latter to the roller axis 54' may be adapted to the actual conditions.

The speed of circulation $v_2$ of the belt conveyors 56 and of the lateral-surface section 80 is preferably at least more or less equal to the speed $v_1$ of the belt conveyor 10. Consequently, the products 14 are handled extremely carefully by virtue of being moved further in a continuous manner. It is also conceivable, however, for the lateral-surface section 80 and the belt conveyors 56 to be driven at a higher speed in order, by virtue of the acceleration of the products 14, to achieve quicker separation of the successive products 14.

It is also conceivable to design the mating element 58 as a roller. The latter is then preferably arranged such that it is prestressed resiliently against a stop and can be forced back, similarly to the manner known, or in the same way as is shown in U.S. Pat. No. 5,556,087. U.S. Pat. No. 5,556,087 is hereby included by reference as a part of this disclosure.

Figure 3:
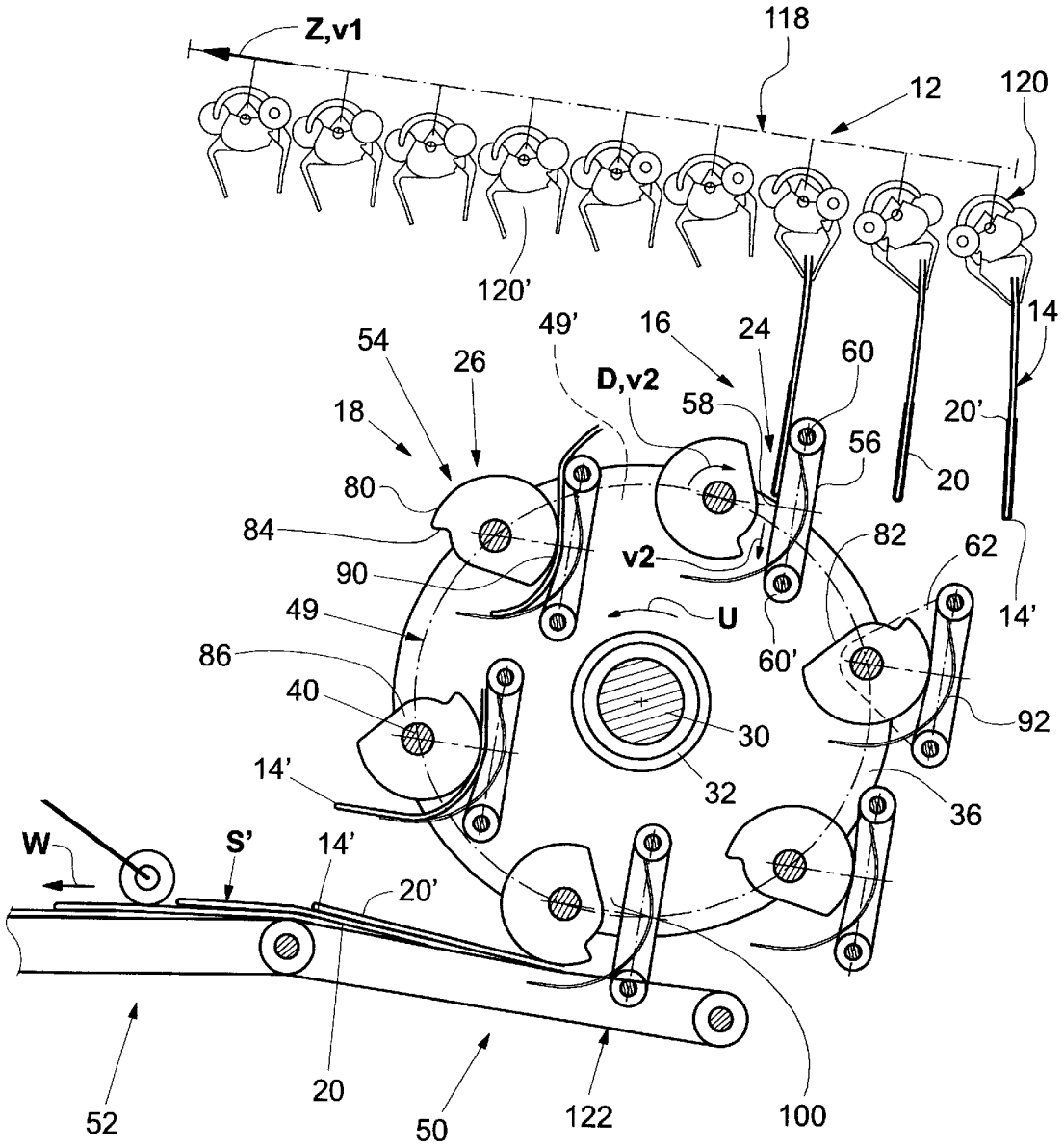
FIG. 3 shows, in longitudinal section, another embodiment of the invention, which is similar to the apparatus shown in FIGS. 1 and 2, that has a different feed conveyor and removal conveyor.

The apparatus which is shown in FIG. 3 is similar to that according to FIGS. 1 and 2. All the figures use the same designations for the parts that correspond to one another.

The intermediate conveyor according to FIG. 3 is of the same design as that according to FIGS. 1 and 2, with the exception that the length of the lateral-surface section 80 of the roller segments 54 is approximately double the size and, by virtue of the rotary position of the center wheel 46 and of the further center wheel 74 being changed in relation to the spindle 30, the conveying elements 26 are aligned such that in the receiving region 16, which is arranged above the spindle 30, the introduction gap 24 runs at least more or less in a vertical direction and tapers downward. Here too, in the receiving region 16, the belt conveyors 56 are trailing in relation to the associated roller segments 54, as seen in the direction of circulation U.

The feed conveyor 12 is designed as a gripper transporter 118 which has transporting grippers 120 which are arranged one behind the other on a drawing member, driven in circulation in the feed direction Z, and are of the same design as the grippers 96 of the removal conveyor 52 (see FIG. 1). The gripper transporter 118 runs beyond the intermediate conveyor 18 and the mouths 120' of the transporting grippers 120 are directed downward, in order to feed the products 14 to the intermediate conveyor 18 in a hanging position.

The gripper transporter 118 and the intermediate conveyor 18 are synchronized such that, in the receiving region 16, the conveying elements 26 mesh with the bottom edge 14' of the products retained by the transporting grippers 120.

At the downstream end of the receiving region 16, the conveying elements 26 form the conveying gap 90 and the transporting grippers 120 open their mouths 120' in order to release the products 14.

The removal conveyor 52, which is designed as a belt conveyor 122, is arranged beneath the intermediate conveyor 18. In the transfer region 50, the conveying direction W of the removal conveyor 52 is counter to the direction of circulation U of the bearing plates 34, 36.

In the transfer region 50, the products 14 are deposited, by the conveying elements 26 of the intermediate conveyor 18, in an imbricated formation S' in which each product rests on the preceding product, it being the case that the product edge 14', which is at the bottom in the fed formation, is now the leading edge. Otherwise, the functioning of the apparatus according to FIG. 3 is the same as that according to FIGS. 1 to 2.

It is conceivable for the gripper transporter 118, downstream of the receiving region 16, to be guided around the intermediate conveyor 18 to the transfer region 50, with the result that in this case the transporting grippers 120 can receive the products 14 from the conveying elements 26. The gripper transporter then serves as feed conveyor 10 and as removal conveyor 52.

It is also conceivable for both the feed conveyor 12 and the removal conveyor 52 of the apparatus to be designed as belt conveyors.

The receiving region 16 and the transfer region 50 may be selected to be at more or less any desired locations. For this purpose, if need be, it is possible to adapt the rotary position of the conveying elements 26 and the drive arrangement of the roller segments 54.

Figure 4:
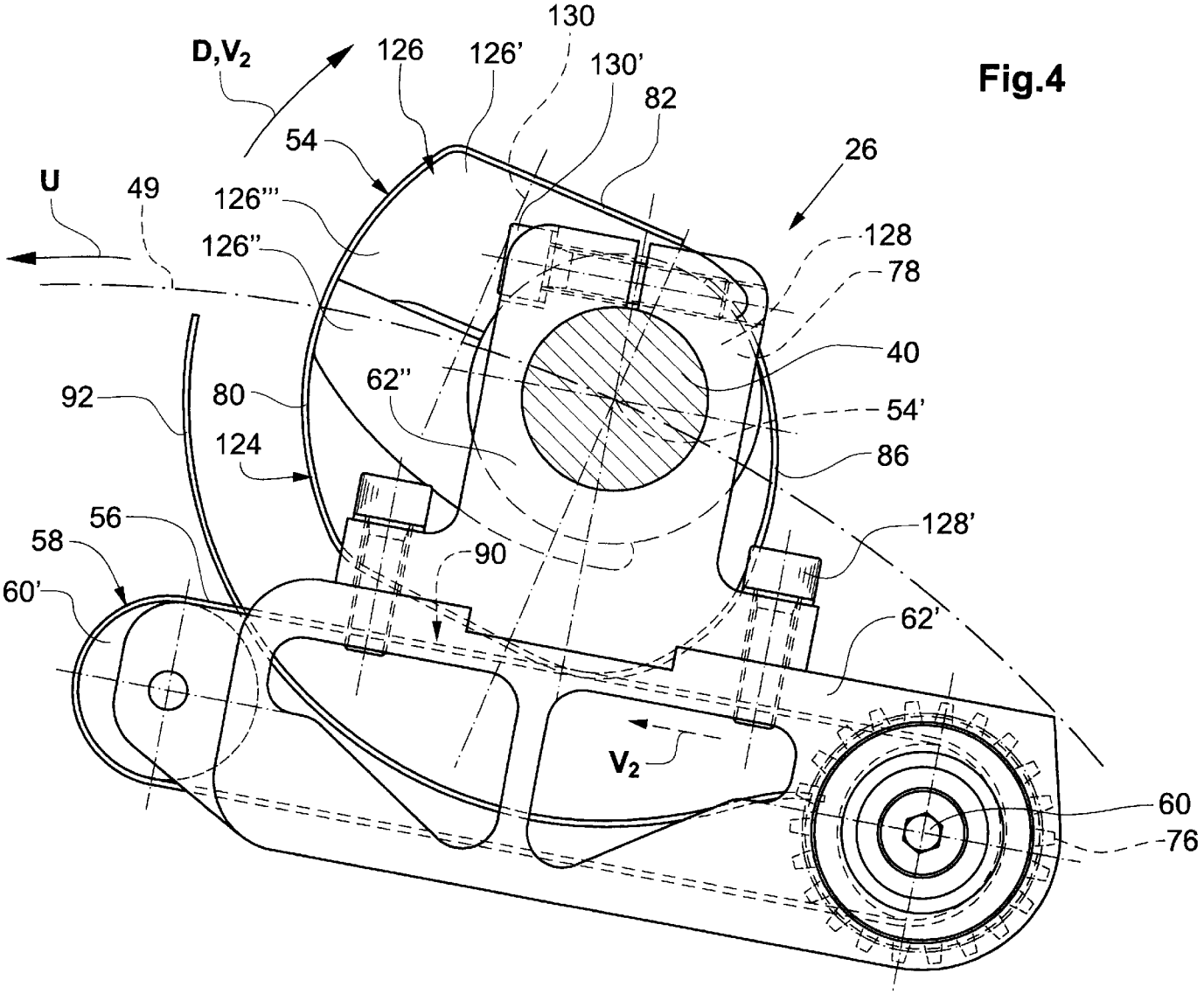
FIG. 4 shows, an apparatus of the type shown in FIGS. 1 and 3, having a further embodiment of the conveying elements of the intermediate conveyor.

A further embodiment of the conveying element 26 is shown in FIG. 4 as has been described above, the same designations are used for the same parts. Here too, each conveying element 26 has two roller segments 54 each with an associated mating element 58 designed as a belt conveyor 56. The roller segments 54 and mating elements 58 are mounted and driven in the same manner as is shown in FIGS. 1 and 2.

The roller segment 54 has a leaf-spring-like leaf-spring-like belt element 124 which, at one end, is fastened on a clamping hub 126, which is fixed on the further hollow shaft 78, and, at the other end, is fastened on the hollow shaft 78 (FIG. 2), for example by means of screws 128. The leaf-spring-like belt element 124 may comprise, for example, a section of a belt-conveyor conveying belt which is usually used for transporting printed products.

The clamping hub 126 comprises two clamping parts 126', 126" which each encloses the further hollow shaft 78 approximately over 120° and, in a state in which they are positioned on the hollow shaft 78 in a frictionally locking manner, are stressed toward one another by means of a tightening screw 120, which is indicated by a dash line. The leaf-spring-like belt element 124 is fastened, by way of an end region which forms the rear section 82, on the leading flank of the leading clamping part 126', seen in the direction of rotation D. As seen counter to the direction of rotation D, the rear section 82 is adjoined by the lateral-surface section 80 of the leaf-spring-like belt element 124, said lateral-surface section running at least more or less concentrically with the shaft 40, extending over approximately 120° and, by way of its radially inner side, butting against the clamping hub 126 over a supporting region 126'" of approximately 50°. Following the lateral-surface section 80, the leaf-spring-like belt element 124 runs with pronounced curvature, in the manner of a spiral, to the hollow shaft 78, against which it butts in a circumferential direction by way of its end section on this side. This spiral section corresponds to the further section 86 in the case of the embodiment shown in FIGS. 1 to 3. In that section of the leaf-spring-like belt element 124 which is located between the clamping hub 126 and the hollow shaft 78, said belt element is not supported in a radially inward direction and may thus be forced back counter to the spring force produced by the leaf-spring-like belt element 124.

The belt conveyors 56 interacting with the belt elements 124, which form the roller segments 54, are guided around deflecting shafts 60, 60', which are mounted in a freely rotatable manner on rectangular carrier plates 62'. The guide elements 92 are also fastened on these carrier plates. The pinion 76 serving for driving the belt conveyors 56 is positioned on the deflecting shaft 60. The carrier plates 62', are fastened by means of screws 128' on in each case one clamping carrier 62", which is fitted onto the shaft 40 and fastened in a rotationally fixed manner thereon, under frictional locking, by virtue of the fastening screw 130' being tightened. In each case one clamping carrier 62" and one carrier plate 62', which is arranged thereon, function in the same way as a carrier plate 62 in the embodiments shown in FIGS. 1 to 3.

The functioning of an intermediate conveyor 18 provided with conveying elements 26 according to FIG. 4 is the same as that of the embodiment described above in conjunction with FIGS. 1 and 2, with the exception of the discharge of the products to a gripper conveyor 52. In the receiving region 16, the belt conveyors 56 and the rear sections 82 form an introduction gap which allows the relevant product 14 to be introduced without obstruction. Subsequently, the belt conveyors 56 and the belt elements 124—by way of their lateral-surface section 80—form a conveying gap 90, it being the case that the support of the belt elements 124 in the supporting region 126'" by the clamping hub 126 ensures that the relevant product 14 is conveyed reliably in the direction of rotation D; see also FIG. 1. The product 14 is conveyed until—in the transfer region 50—it arrives with the leading edge 14' against the base of the open mouth 98 of a gripper 96 of the removal conveyor 52. At this point in time, the supporting region 126'" has moved away from the belt conveyor 56 and the roller segment 54 assumes more or less the position which is shown in FIG. 4. Since the end region of the lateral-surface section 80 of the leaf-spring-like belt element 124 which is now adjacent to the conveying gap 90 is not supported in the radially inward direction, the friction between the product 14, on the one hand, and the belt conveyor 56 and belt elements 124, on the other hand, is reduced in relation to the initial conveying phase in the intermediate conveyor 18, with the result that, on account of the sliding friction which has been made possible in the conveying gap 90, the product 14 is retained in abutment against the base of the gripper mouth 98, without any damage being incurred, until the gripper mouth 98 has been closed. Since the retaining force of the closed grippers 96 is greater than that in the conveying gap 90, a product 14 which has been gripped by the gripper 96 can be drawn out of the conveying element 26 without being damaged, even if the conveying gap 90—as a result of the rotation of the roller segment 54—has not yet been eliminated.

The design of the intermediate conveyor 18 with conveying elements 26 according to FIG. 4 allows careful and reliable processing of different product formats without any setting and adjustment operations.

What is claimed is:

1. An apparatus for processing flexible, sheet-like products, having a feed conveyor (12) for delivering the products (14) to a receiving region (16) of an intermediate conveyor (18);

said intermediate conveyor (18) having a number of conveying elements (26) arranged one behind the other, and moved in the direction of circulation (U) along a circulatory path (49) running through the receiving region (16) and through a transfer region (50) and which changes the position of the products (14) fed to successive conveying elements (26) in the receiving region (16), such that the sequence of the products remains the same and the mutually facing sides (20, 20') of the products (14) are changed round, said conveying elements (26) including a roller segment (54), which is driven in rotation in a direction of rotation (D) about its roller axis (54'), running at right angles to the circulatory path (49), and a separate mating element (58), which interacts with said roller segment (54), during movement through the receiving region (16), a rear section (82) of the roller segment (54) and the mating element (58) form an introduction gap (24) for the fed product (14), in a further region (49') of the circulatory path (49), said further region (49') following the receiving region (16) in the direction of circulation (U), a circumferentially running lateral-surface section (80) of the roller segment (54), said lateral-surface section (80) following the rear section (82), and the mating element (58) form a conveying gap (90) for said product (14), said intermediate conveyor (18) having a control device (48) for keeping the conveying elements (26) in substantial mutual parallel position to one another; and a removal conveyor (52) which adjoins the intermediate conveyor (18) in the discharge region (50) and receives the products (14) from the conveying elements (26).

2. The apparatus as claimed in claim 1, wherein each mating element (58) has an endless belt (56) which interacts with the roller segment (54).

3. The apparatus as claimed in claim 2, wherein the endless belt (56) is driven counter to the direction of rotation (D) of the roller segment (54), and wherein, at the receiving location (16), the endless belt (56) projects beyond the roller segment (54) in the direction of the feed conveyor (12).

4. The apparatus as claimed in claim 1, wherein each roller segment (54) includes a guide element (92) in order to deflect the product (14) around the roller segment (54) downstream of the mating element (58).

5. The apparatus as claimed in claim 1, wherein the number of roller segments (54) are mounted rotatably, and distributed in a circumferential direction, on a bearing plate (34, 36), driven in rotation in the direction of circulation (U), with roller axes (54') running parallel to the rotary axis (30) of the bearing plate (34, 36) and are driven counter to the direction of circulation (U) of the bearing plate (34, 36) by means of a drive arrangement (64) configured as a planet gear mechanism.

6. The apparatus as claimed in claim 5, wherein the control device (48) is designed as a planet gear mechanism.

7. The apparatus as claimed in claim 1, wherein the feed conveyor (12) has a belt conveyor (10).

8. The apparatus as claimed in claim 7, wherein, in the receiving region (16), the introduction gap (24) of the conveying elements (26) is temporarily aligned with the belt conveyor (12) and can thus receive the leading edge (14') of the said fed product (14) without obstruction.

9. The apparatus as claimed in claim 7, wherein the circumferential speed ($v_2$) of the roller segment (54) is at least more or less equal to, or greater than, the conveying speed ($v_1$) of the belt conveyor (10).

10. The apparatus as claimed in claim 1, wherein the removal conveyor (52) has a gripper conveyor (52'), of which, in the transfer region (50), the open grippers (96) are directed toward the intermediate conveyor (18) and mesh with the leading edge (14') of the products (14).

11. The apparatus as claimed in claim 10, wherein the gripper conveyor (52') runs above the intermediate conveyor (18) and the feed conveyor (12) runs substantially horizontal to the intermediate conveyor (18).

12. The apparatus as claimed in claim 10 wherein the removal conveyor (52) and the conveying elements (26) are synchronized such that the conveying gap (90) is eliminated at least more or less at the point in time at which the corresponding gripper (96) is closed, and wherein the roller segment (54) and the mating element (58) then form a guidance gap (100) for the product (14) gripped by the gripper (96).

13. The apparatus as claimed in claim 1, wherein the feed conveyor (12) has a gripper transporter (118) with transporting grippers (120) which are arranged one behind the other and are driven in circulation, and, in the receiving region (16), the introduction gap (24) of the conveying elements (26) is aligned with the preferably downwardly oriented transporting grippers (120) and can thus receive the edge (14') of the fed product (14) without obstruction.

14. The apparatus as claimed in claim 1, wherein the roller segment (54) is of resilient design.

* * * * *

UNITED STATES PATENT AND TRADEMARK OFFICE

CERTIFICATE OF CORRECTION

PATENT NO. : 6,196,538 B1
DATED : March 6, 2001
INVENTOR(S) : Hans-Ulrich Stauber and Alex Keller It is certified that error appears in the above-identified patent and that said Letters Patent is hereby corrected as shown below:

Title page,
Item [30], Foreign Application Priority Data, change "1283/98" to -- 1998 1283/98 --.

Signed and Sealed this

Second Day of October, 2001

*Attest:*

Nicholas P. Godici

*Attesting Officer*

NICHOLAS P. GODICI
*Acting Director of the United States Patent and Trademark Office*